US006402366B1

(12) United States Patent
Eichholzer

(10) Patent No.: US 6,402,366 B1
(45) Date of Patent: Jun. 11, 2002

(54) DRUM UNIT FOR RECEIVING BULK MATERIAL FOR SURFACE TREATMENT

(76) Inventor: Ernst Eichholzer, Vellano, CH-6583 S. Antonio (CH)

( * ) Notice: Subject to any disclaimer, the term of this patent is extended or adjusted under 35 U.S.C. 154(b) by 0 days.

(21) Appl. No.: 09/555,651

(22) PCT Filed: Jun. 26, 1998

(86) PCT No.: PCT/IB98/00989

§ 371 (c)(1),
(2), (4) Date: Feb. 26, 2001

(87) PCT Pub. No.: WO00/00669

PCT Pub. Date: Jan. 6, 2000

(51) Int. Cl.[7] ..... B01F 9/02; B01F 15/02

(52) U.S. Cl. ..... 366/220; 366/349; 204/213; 222/213; 118/418

(58) Field of Search ..... 366/220, 225, 366/226, 228, 229, 230, 234, 219, 349, 347; 204/213; 118/418; 220/213, 345.2, 315, 345.4, 833; 49/158

(56) References Cited

U.S. PATENT DOCUMENTS

| | | | | | |
|---|---|---|---|---|---|
| 912,041 | A | * | 2/1909 | Snow | 220/326 |
| 1,523,939 | A | * | 1/1925 | Evans | 220/213 |
| 2,558,220 | A | * | 6/1951 | McLachlan | 49/200 |
| 2,921,009 | A | * | 1/1960 | Jenks et al. | 266/225 |
| 2,956,943 | A | * | 10/1960 | Hoegh | 366/226 |
| 2,960,778 | A | * | 11/1960 | Cowlin | 366/233 |
| 3,165,226 | A | * | 1/1965 | Files | 220/211 |
| 3,206,058 | A | * | 9/1965 | Widigen | 220/211 |
| 3,283,944 | A | * | 11/1966 | Richardson | 220/252 |
| 3,484,360 | A | * | 12/1969 | Sandrock | 366/234 |
| 3,560,036 | A | * | 2/1971 | Kiefer et al. | 204/213 |
| 3,583,739 | A | * | 6/1971 | Gill | 204/213 |
| 3,623,627 | A | * | 11/1971 | Bolton | 220/252 |
| 3,687,421 | A | | 8/1972 | Kanazu | 366/188 |
| 3,827,182 | A | * | 8/1974 | Van Helleputte | 220/213 |
| 3,850,737 | A | * | 11/1974 | Lui | 204/213 |
| 3,861,654 | A | * | 1/1975 | Singleton | 366/234 |
| 3,944,189 | A | | 3/1976 | Singleton | 366/220 |
| 3,957,254 | A | * | 5/1976 | Charpentier | 366/220 |
| 4,154,538 | A | * | 5/1979 | Linnhoff et al. | 366/234 |
| 4,390,399 | A | * | 6/1983 | McInnes | 204/213 |
| 4,422,774 | A | * | 12/1983 | Little | 366/347 |
| 4,445,993 | A | * | 5/1984 | Stutz et al. | 204/213 |
| 4,521,288 | A | * | 6/1985 | McInnes | 204/213 |
| 4,736,868 | A | * | 4/1988 | Carmon | 366/347 |
| 4,918,660 | A | * | 4/1990 | Perrot | 366/220 |
| 5,733,040 | A | * | 3/1998 | Zuk et al. | 366/347 |

FOREIGN PATENT DOCUMENTS

| | | |
|---|---|---|
| DE | 1218952 | 6/1966 |
| DE | 1546154 | 3/1970 |
| DE | 2243147 | 3/1974 |
| GB | 2203449 | 10/1988 |

OTHER PUBLICATIONS

Patent Abstracts of Japan, vol. 016, No. 466 (C–0989), Sep. 28, 1992 & JP 04 166256 A (Tokai Rubber Ind Ltd), Jun. 12, 1992.

* cited by examiner

*Primary Examiner*—Tony G. Soohoo
(74) *Attorney, Agent, or Firm*—Cooper & Dunham LLP; Donald S. Dowden

(57) ABSTRACT

The drum of the drum unit has a plurality of jacket walls. One jacket wall is designed as a freely pivotable lid. A cam disk is located in the drum. In certain positions the lid rests at its free end on the cam disk such that it is controlled by same. When the drum rotates in one direction, the cam disk blocks the lid in its open position such that an automatic discharging of the drum takes place. At a rotating in the opposite direction the lid remains closed due to its force of gravity, so that neither a manual manipulation nor operating apparatuses for a moving of the lid are needed.

6 Claims, 2 Drawing Sheets

DRUM UNIT FOR RECEIVING BULK MATERIAL FOR SURFACE TREATMENT

BACKGROUND OF THE INVENTION

1. Field of the Invention

The present invention relates to a drum unit for receiving bulk material for surface treatment, including a drum having jacket walls which end at both sides at a end disk, of which one jacket wall is designed as a lid which can be opened and closed for a charging of and a discharging from the drum.

2. Description of the Prior Art

Such drum units are used in the industrial field of surface treatments, e.g. for an electroplating, pickling, phosphating, cleaning, generally depositing a coating onto articles. Such articles are generally structures which can be handled as bulk material, such as articles like metal fittings, nuts, threaded bolts, further articles which are used in the electronic industries, articles for watches and also for jewelry.

In addition to a depositing a coating onto articles, drum units are also used in connection with a rinsing and drying of the articles. A drum unit includes besides e.g. a driving motor and its controls, drive transmission members, structures for the feeding of electric power, a drum for the receipt of the commodity to be treated which in operation rotates of a low speed. The walls of the drum may be of a screen like design or also may be designed with perforations, depending from the treatment to be made-of the respective articles. These drum walls may, furthermore, have a curvilinear, rectilinear or also an angular cross-sectional shape.

The drum jacket walls may also be designed in such a way, that the drum has a triangular cross-sectional shape with rounded corner areas, which drums are also designated as delta drums. The drum jacket walls may also be arranged in a rosette-like manner, such as is the case of semitube drums.

At least one of the drum walls or a segment of the drum jacket, resp. is designed as a lid, which can be opened for charging and discharging the drum, and is shut, closed during the treatment. The charging of the drum can proceed either manually or by a charging apparatus. The discharging of the drum may also proceed manually, or then so, that the drum having its lid opened or removed is rotated into a discharging position, possibly by a reversing of the rotation of the drum, so that the treated articles may fall into a collecting bin.

Until these days the opening and closing of the lid was accomplished manually or by special automatically operating apparatuses.

In case of a manual operation the locking of the lid is achieved for instance by locking clamps or locking straps, which is considered as a laborious task and in addition gives rise to the danger in that the operator may contact a treatment medium which is harmful to the human skin. Automatically operating apparatuses for an opening and a closing of the lid are expensive, require a lot of space and may also suffer break downs.

The DE-A-1 546 154 discloses a drum for the treatment of bulk material having a lid for a charging or discharging of the drum, arranged at a sidewall of the drum which orbits when the drum is rotating. The lid is pivotable parallel to the axis of rotation of the drum. The lid includes at one of its longitudinal edges a lever and a guiding roller, which cooperates with a cam disk which, is rigidly mounted to the frame of the drum. The key ring like cam portion included two end areas, which are at a distance from each other due to an opening acting as control recess.

The shape of this cam disk necessitates, however, that the lid must have the lever with the guiding roller, which parts increase costs, are prone to failures and their mounting is quite consuming. Furthermore, this cam part does not allow a direct safe complete opening of the lid, so that it is possible that specifically during the discharging a certain amount of the commodity which has been treated can be caught between the only partly opened lid and the inner side of the drum.

SUMMARY OF THE INVENTION

Hence, it is a general object of the present invention to provide a drum unit for receiving bulk material for surface treatment which includes a drum with a lid to be opened and closed which is supported to freely pivot around a pivot axis, which drum includes at least one cam disk which is operative to control the pivotal position of the lid, whereby any pivotal position of the lid is determined exclusively by its force of gravity and by the cam disk, so that the lid opens and closes by itself on its own exclusively dependent from the rotational position of the drum.

A further object of the invention is to provide a drum unit for receiving bulk material for surface treatment, including a drum having jacket walls which end of both sides at a end disk, of which one jacket wall is designed as a lid to be opened and closed for a charging and discharging the drum, which lid is supported at one of its longitudinal edges for a pivoting around a pivot axis which extends parallel to an axis of rotation of the drum, which drum includes at least one stationary cam disk for a controlling of the rotational position of the lid, which lid has at least one guiding portion adapted to co-operate with mentioned at least one stationary cam disk, which at least one stationary cam disk has a circumferential portion which has the shape of a circular arc and has a first end area and a second end area, which end areas are located at a circumferential distance from each other; and has further a control recess having a first and a second end, which ends are located at a circumferential distance from each other, which first end is shaped as a lid blocking surface; which lid blocking surface is followed in turn by a first, approximately rectilinear transition portion which extends up to the first end area of the circular arc shaped circumferential portion; and having a second, approximately rectilinear transition portion following the second end of the control recess and extending up to the second end area of the circular arc shaped circumferential portion.

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION OF THE INVENTION

Figure 1:
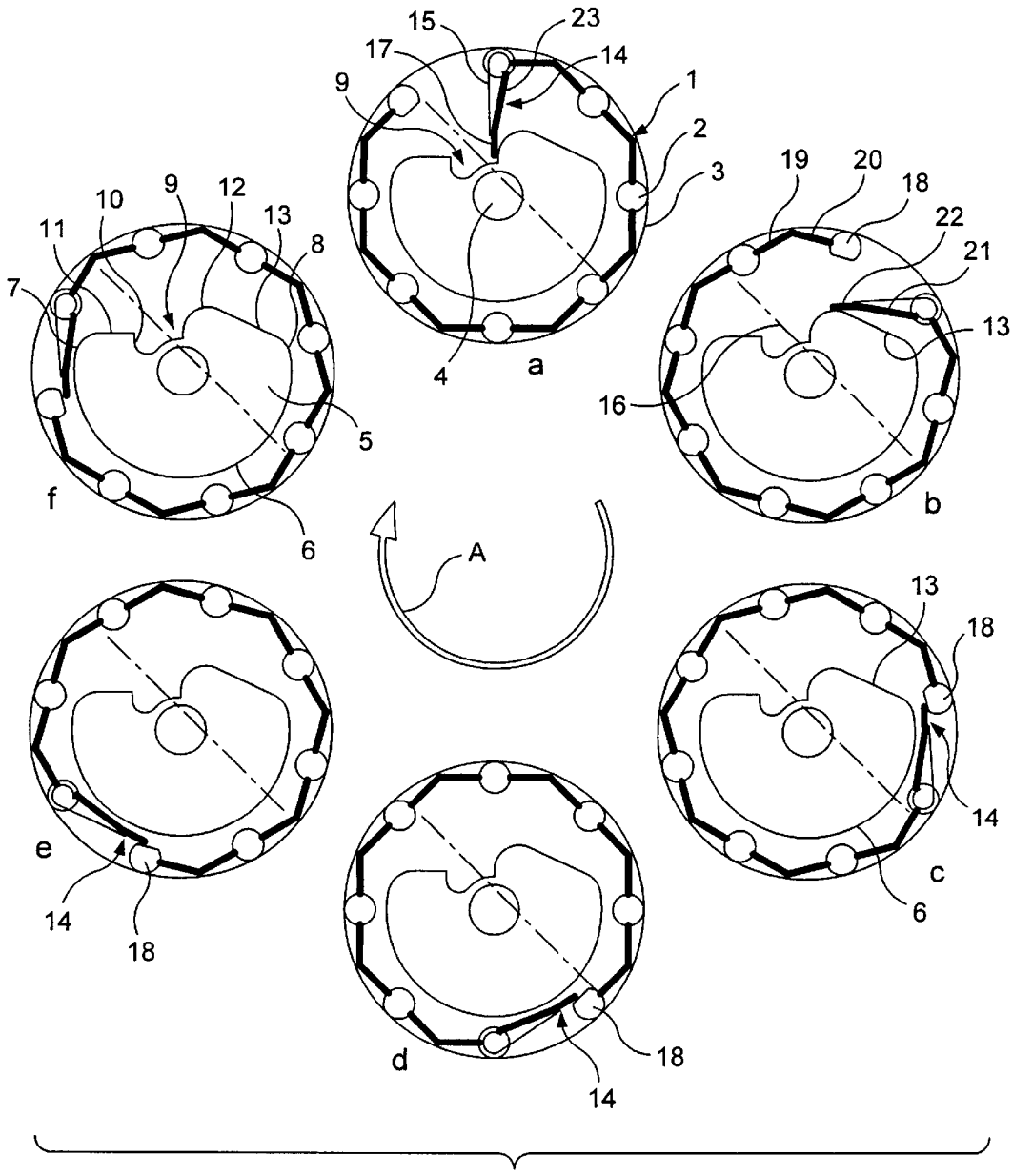
FIGS. 1*a–f* illustrate schematically a cross-section through a drum depicting the movements during the course of operation "close lid"

FIG. 1 illustrates a schematic cross-section through a drum of a drum unit for a surface treatment of bulk material shown in various positions.

Because the design of such drum units and their drums are well known to the person skilled in the art only those structures are illustrated in the schematic figures, which are needed for the understanding of the invention.

The drum includes jacket walls 1, which are designed often as perforated planar or curvilinearly extending plates. In the illustrated embodiment the jacket walls 1 have an angular cross-sectional shape. The jacket walls 1 are supported at their longitudinal edges in ledges 2, also termed edge ledges, or are firmly mounted to these ledges. These ledges 2 are mounted at both of their ends to an end disk 3 or end wall, respectively. In some embodiments these ledges 2 are made integrally with the end disks 3. One of the end disks 3 is usually firmly connected according to generally known designs to a (not illustrated) spur gear for the transmission of the driving force of a motor such as well known to the person skilled in the art. The trunnions of the end disks are identified generally by the reference numeral 4. A stationary cam disk 5 is mounted inside the drum adjacent the end disk 3 which generally rotates during the treatment operation. Also possible is an embodiment in which the cam disk 5 is mounted outside of the drum, but also directly adjacent the end disk 3, e.g. at a bearing bracket of the drum.

The cam disk 5 includes a circumference portion 6 having the shape of a circular arc which has a first end area 7 and a second end area 8 located at a distance from the first end area 7. The cam disk 5 includes, furthermore, a control recess 9. This control recess 9 is bordered at a first end seen in the direction of the circumference of the cam disk 5, by a lid blocking surface 10. This lid blocking surface 10, still seen in the direction of the circumference, is followed by a rectilinear first transition portion 11, which ends at the first end area 7 of the circular arc shaped circumference portion 6. The end 12 of the control recess 9 opposite of the lid blocking surface 10 is followed by a second rectilinear transition portion 13 which ends at the second end area 8 of the circular are shaped circumference portion 6.

Now, one of the jacket walls 1 of the drum is designed as a freely pivotable lid 14. This lid 14 is pivotally mounted along a longitudinal edge 23 to one of the bar member, i.e. ledges 2, whereby this ledge 2 is structured as a part of a hinge. The reference numeral 15 designates at least one rib of the lid 14. It must, however, be noted that the rib 14 must not necessarily be present.

Accordingly, the lid 14 can freely pivot around a pivot axis, which extends parallel to the axis of rotation of the drum, which as generally known rotates during the operating of the drum unit.

As can clearly be seen, the two legs 19, 20, seen in cross-section, of the angle described by the jacket walls 1, are of equal length. However, at the lid 14 the leg 21 of the angle described by the wall portions of the lid 14 which is closer to the ledge 2 is longer than the leg 22 ending at the free end of the lid 14.

The obliquely extending dash-dotted line 16 identifies the upper limit or surface, respectively of the commodity present in the drum. As generally known, this upper limit, i.e. the upper surface of the commodity which has been placed in the drum extends not horizontally, when the drum rotates, but rather obliquely at a angle of repose which is characteristic for a respective bulk material.

FIG. 1 illustrates six positions *a–f* of the drum. During the treating process the drum rotates basically in the direction of the arrow A. It is understood that the drum rotates around its own axis and not around the center of the circular arc shaped arrow A.

Quite obviously, however, in order to deposit a coating onto the commodity, the articles to be treated, the drum is lowered into a bath and lifted out of the bath after the treatment.

FIG. 1*a* illustrates the drum in the charging position, i.e. the position in which the commodity to be treated is charged into the drum by means of for instance a charging apparatus.

Due to its force of gravity the freely pivotable lid 14 hangs downwards. It can assume the illustrated position because its free longitudinal edge 17 which cooperates as guiding portion with the cam disk 5 can project into the control recess 9 of the cam disk 5.

Now, the drum begins to rotate slowly in the direction of the arrow A. Thus, the longitudinal edge 17 of the lid 14 slides out of the control recess 9, over its second end 12 and onto the second rectilinear portion 13, such as illustrated in FIG. 1*b*.

During the continued rotational movement of the drum from the position according to FIG. 1*b* to the position according to FIG. 1*c* the longitudinal ledge 17 slides over the second rectilinear portion 13 of the stationary cam disk 5 up to the circumference portion 6 and moves during the continued rotation of the drum into contact with the ledge 18 acting as abutment.

The drum continues to rotate and the lid 14 remains due to its gravitational force and due to the contents of the drum lying on the lid (surface line 16) in its closed position such as illustrated in FIG. 1*d*. During the continued rotating into the positions according to FIGS. 1*e* and 1*f* the lid 14 remains in its closed position and can not open until its reaches the position according to FIG. 1*a*, in which the free longitudinal edge 17 of the lid 14 can again fall into the control recess 9.

Attention is now drawn to FIGS. 2*a–f*.

In order to open the drum it is rotated in the opposite direction, or sense, respectively, in the direction of the arrow B. The starting position is depicted in FIG. 2*a*, although the reversing may obviously be initiated from any one of the rotational positions of FIG. 1.

The lid 14 projects at its free longitudinal edge 17, the guiding portion, into the control recess 9 and is, therefore, located in its open position.

Figure 2:
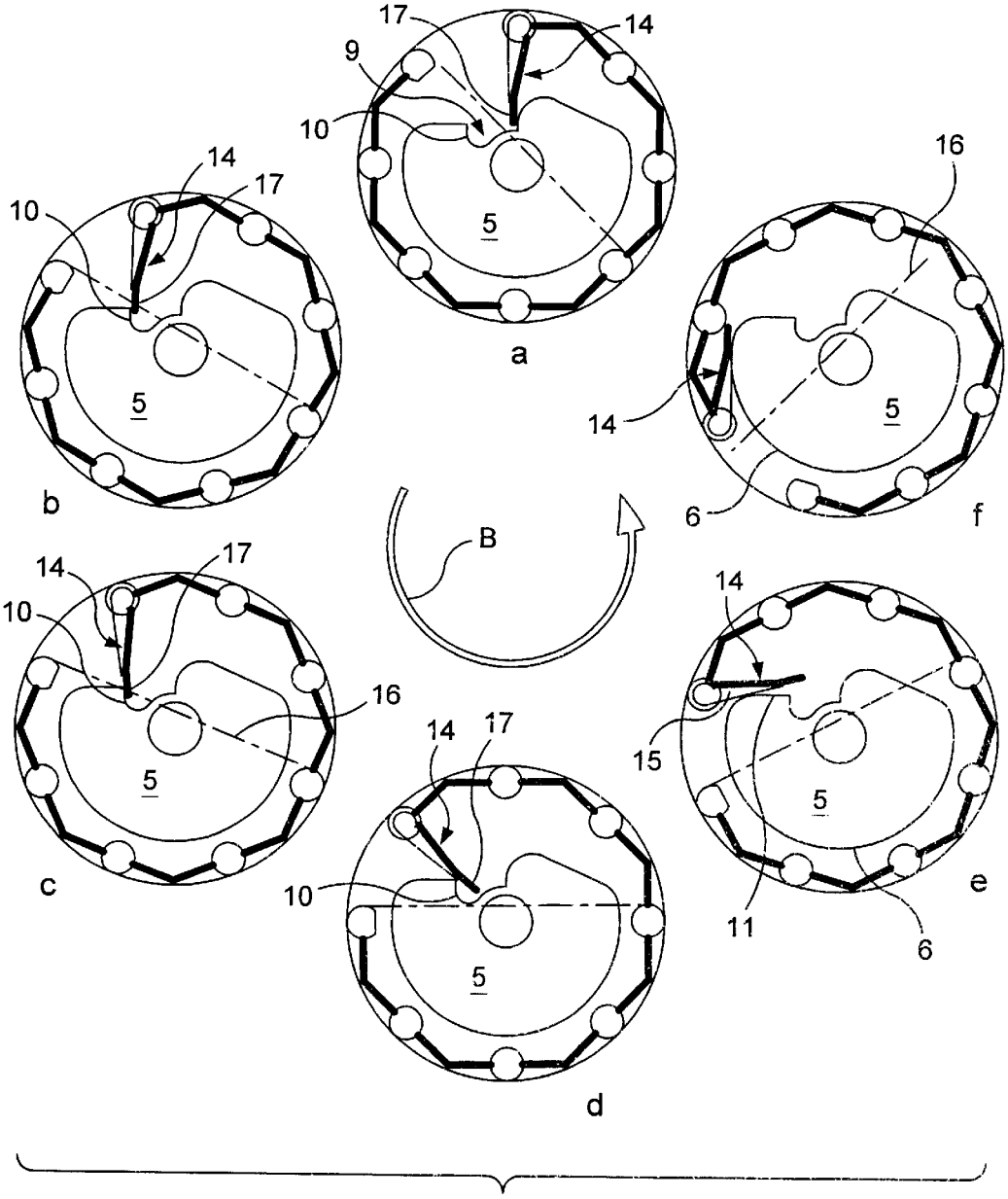
FIGS. 2*a–f* illustrates the drum of FIG. 1 depicting the movements during the course of operation "open lid".

If now the drum rotates from the position of FIG. 2*a* to the position of FIG. 2*b*, the longitudinal edge 17 of the lid 14 will contact the lid blocking surface 10 and accordingly, the lid 14 is blocked. When now the drum continues to rotate through the positions according to FIGS. 2*b*–2*d*, the lid 14 is continuously held blocked in its open position by the lid blocking surface 10. It is, thereby, quite obvious that the position of the surface of the commodity located in the drum changes such as illustrated by the line 16.

During the rotating of the drum from the position according to FIG. 2*d* to the position according to FIG. 2*e* the lid 14 slides with its rib 15 over the first rectilinear transition portion 11 of the cam disk 5 and is pivoted still further inwards. The lid 14 reaches finally the circular arc shaped circumference portion 6 and is accordingly pivoted into the complete open position, whereby such that, as can clearly be seen in FIG. 2*f*, the commodity can fall out of the drum. As can be seen, the lid 14 remains completely open during its movement from the position according to FIG. 2*f* to the position according to FIG. 2*a*, such that the drum can be emptied safely.

In the position according to FIG. 2*a* the drum is ready to receive the next following charge and is thereafter rotated again in the direction of the arrow A of FIG. 1 for the treatment of the next following charge.

As accordingly can be seen, in order to move the lid neither a manual manipulation nor any addition auxiliary apparatuses are needed.

The cam disk can obviously also be placed adjacent at the outside of the drum adjacent one of the end disks 3 in which case the lid 14 could be controlled by the cam disk 5 via a simple guiding member extending over the respective end disk 3 in the sense of an outer extension of the lid 14.

While there is shown and described a presently preferred embodiment of the invention, it is to be distinctly understood that the invention is not limited thereto but may be otherwise variously embodied and practised within the scope of the following claims.

What is claimed is:

1. A drum unit for receiving bulk material for surface treatment, including a drum having jacket walls which end at both sides at an end disk, of which one jacket wall is designed as a lid to the opened and closed for charging and discharging said drum, which lid is supported at one of its longitudinal edges for a pivoting around a pivot axis which extends parallel to an axis of rotation of said drum, which drum includes at least one stationary cam disk for a controlling of the rotational position of said lid, which lid has at least one guiding portion adapted to co-operate with said at least one stationary cam disk;

said at least one stationary cam disk comprising a circumferential portion which has the shape of a circular arc and having a first end area and a second end area, which end areas are located at a circumferential distance from each other;

further comprising a control recess having a first and a second end, which ends are located at a circumferential distance from each other, which first end is shaped as a lid blocking surface;

which lid blocking surface is followed in turn by a first, approximately rectilinear transition portion which extends up to said first end area of said circular arc shaped circumferential portion;

and comprising a second, approximately rectilinear transition portion following the second end of said control recess and extending up to said second end area of said circular arc shaped circumferential portion.

2. The drum unit of claim 1, wherein said guiding portion of said pivotable lid is formed by its longitudinal edge which is located opposite of the pivotably supported longitudinal edge.

3. The drum unit of claim 1, wherein each jacket wall comprises two adjacent longitudinal portions having the same width and extending at an angle relative to each other, and wherein said lid comprises two adjacent longitudinal portions having different widths and extending of an angle relative to each other, further wherein said lid is pivotally supported at the longitudinal edge of the broader portion.

4. The drum unit of claim 3, wherein each jacket wall is held at its longitudinal edges in ledges which are firmly mounted to said end disks, of which ledges one acts as a hinge portion for the lid pivotally mounted thereto.

5. The drum unit of claim 4, wherein at least one cam disk is located inside of the drum and directly adjacent one end disk.

6. The drum unit of claim 4, wherein at least one cam disk is mounted outside of the drum and adjacent one end disk, and wherein said lid is connected to a feeler member which contacts said cam disk.

* * * * *